US006808474B2

(12) United States Patent
Tang

(10) Patent No.: US 6,808,474 B2
(45) Date of Patent: Oct. 26, 2004

(54) LAPTOP ROPE PULLING EXERCISER

(76) Inventor: Jack Tang, 1F, No. 7, Alley 27, Lane 247, Chung Cheng Rd., Hsin Tien City, Taipei Hsien (TW)

( * ) Notice: Subject to any disclaimer, the term of this patent is extended or adjusted under 35 U.S.C. 154(b) by 0 days.

(21) Appl. No.: 10/623,553

(22) Filed: Jul. 22, 2003

(65) Prior Publication Data

US 2004/0192509 A1 Sep. 30, 2004

(30) Foreign Application Priority Data

Mar. 28, 2003 (TW) ..... 92204856 U

(51) Int. Cl.[7] ..... A63B 21/018; A63B 7/04
(52) U.S. Cl. ..... 482/51; 482/37; 482/120
(58) Field of Search ..... 482/51, 37, 114, 482/120, 145, 115–119, 148

(56) References Cited

U.S. PATENT DOCUMENTS 3,599,974 A * 8/1971 Price ..... 482/118
5,380,258 A * 1/1995 Hawley, Jr. ..... 482/37
5,484,360 A * 1/1996 Haber et al. ..... 482/37
5,580,338 A * 12/1996 Scelta et al. ..... 482/62
6,261,208 B1 * 7/2001 Carson, Jr. ..... 482/37

* cited by examiner

*Primary Examiner*—Stephen R. Crow
(74) *Attorney, Agent, or Firm*—Bacon & Thomas PLLC

(57) ABSTRACT

A laptop rope pulling exerciser is composed of a base, an operating device, and a resistance device. The base includes two arched portions recessed inwards respectively at two sides thereof for positioning the user's two laps and a wedged portion at a top end thereof. The operating device includes an elongated housing having a wedging portion positioned respectively at a bottom side of the housing and connected with the wedged portion, two chin portions extending outwards horizontally respectively from a top end and a bottom end of the housing, a plurality of pulleys mounted inside the housing, an interfering portion, and a continuous rope extending through the pulleys and the interfering portion for running inside and outside the housing between the two chin portions. The resistance device is adjustably mounted inside the housing for causing the rope to be tightened or loosened.

8 Claims, 7 Drawing Sheets

LAPTOP ROPE PULLING EXERCISER

BACKGROUND OF THE INVENTION

1. Field of the Invention

The present invention relates generally to exercise equipment, and more particularly, to a laptop rope pulling exerciser which can be put on laps and pulled by hands for exercise.

2. Description of the Related Art

According to U.S. Pat. No. 6,261,208, it discloses a rope pulling frictional exercise device which is pulled against a resistance device by two hands for achieving an exercise purpose. While the exercise device is operated, the user stands on a base portion of a U-shaped housing together with a pair of tic down straps coupled to a belt of the user to hold the user down and with a pair of ankle straps coupled to the user's feet to hold the user down, and then the user pulls a rope downwards for exercise.

However, it needs complex preparatory steps, e.g. using a rope to hold down the feet and the belt of the user before operating the aforementioned exercise device. In addition, the exercise device is too extremely large-sized and heavy for a regular user to install, store, and place at home, even for a gym. Moreover, the exercise device costs a lot and is difficult to install.

SUMMARY OF THE INVENTION

The primary objective of the present invention is to provide a laptop rope pulling exerciser which is more small-sized than the prior art and can be operated on a user's laps for exercise.

The secondary objective of the present invention is to provide a laptop rope pulling exerciser which is structurally smaller than the prior art.

The foregoing objectives of the present invention are attained by the laptop rope pulling exerciser which is composed of a base, an operating device, and a resistance device. The base includes two arched portions recessed inwards respectively at two sides thereof for positioning the user's two laps and a wedged portion at a top end thereof. The operating device includes an elongated housing having a wedging portion positioned respectively at a bottom side of the housing and connected with the wedged portion, two chin portions extending outwards horizontally respectively from a top end and a bottom end of the housing, a plurality of pulleys mounted inside the housing, an interfering portion, and a continuous rope extending through the pulleys and the interfering portion for running inside and outside the housing between the two chin portions. The resistance device is adjustably mounted inside the housing for causing the rope to be tightened or loosened. In operation, put the two laps into the two arched portions and pull the rope with two hands for exercise.

DETAILED DESCRIPTION OF THE INVENTION

Figure 1:
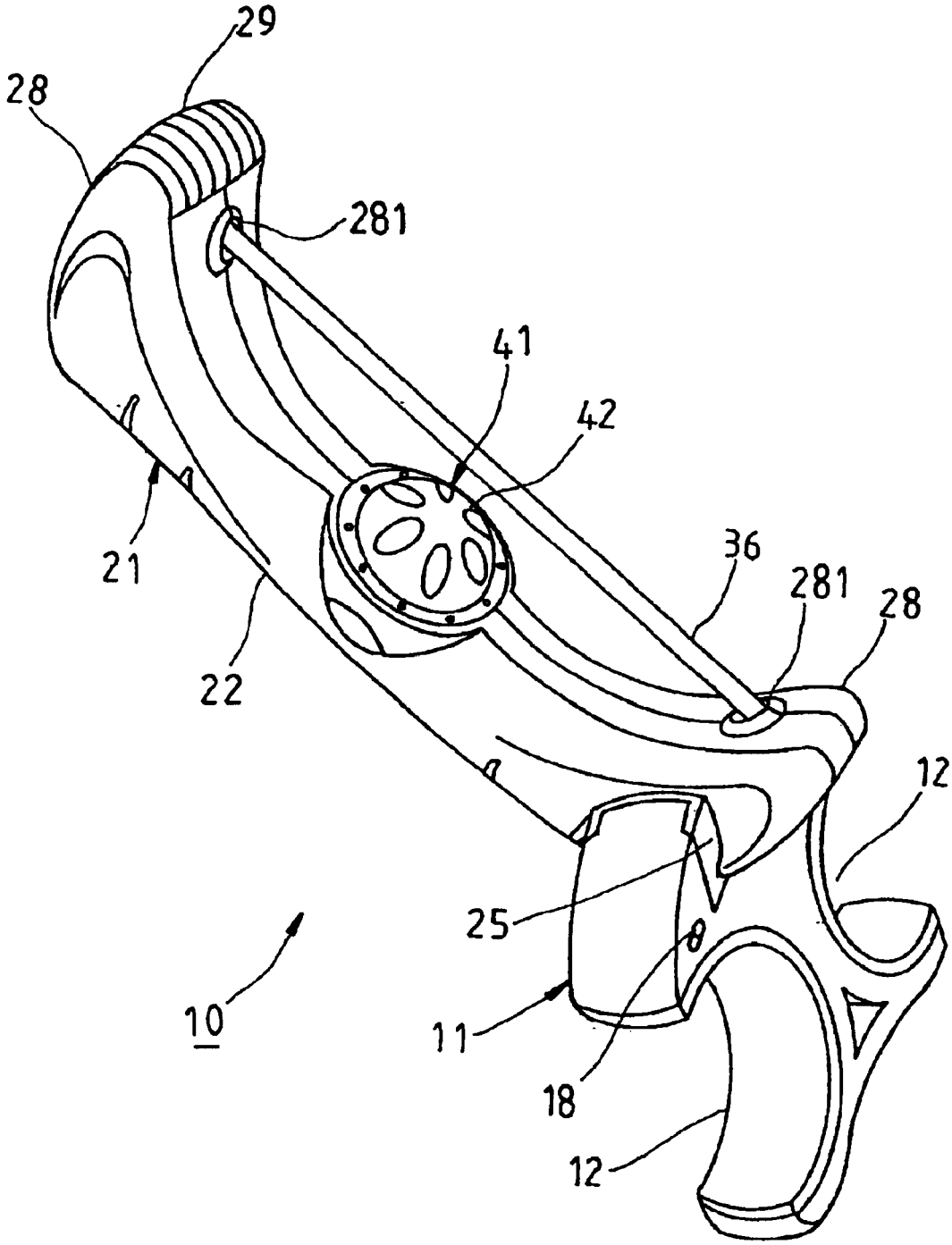
FIG. 1 is a perspective view of a preferred embodiment of the present invention.
Figure 2:
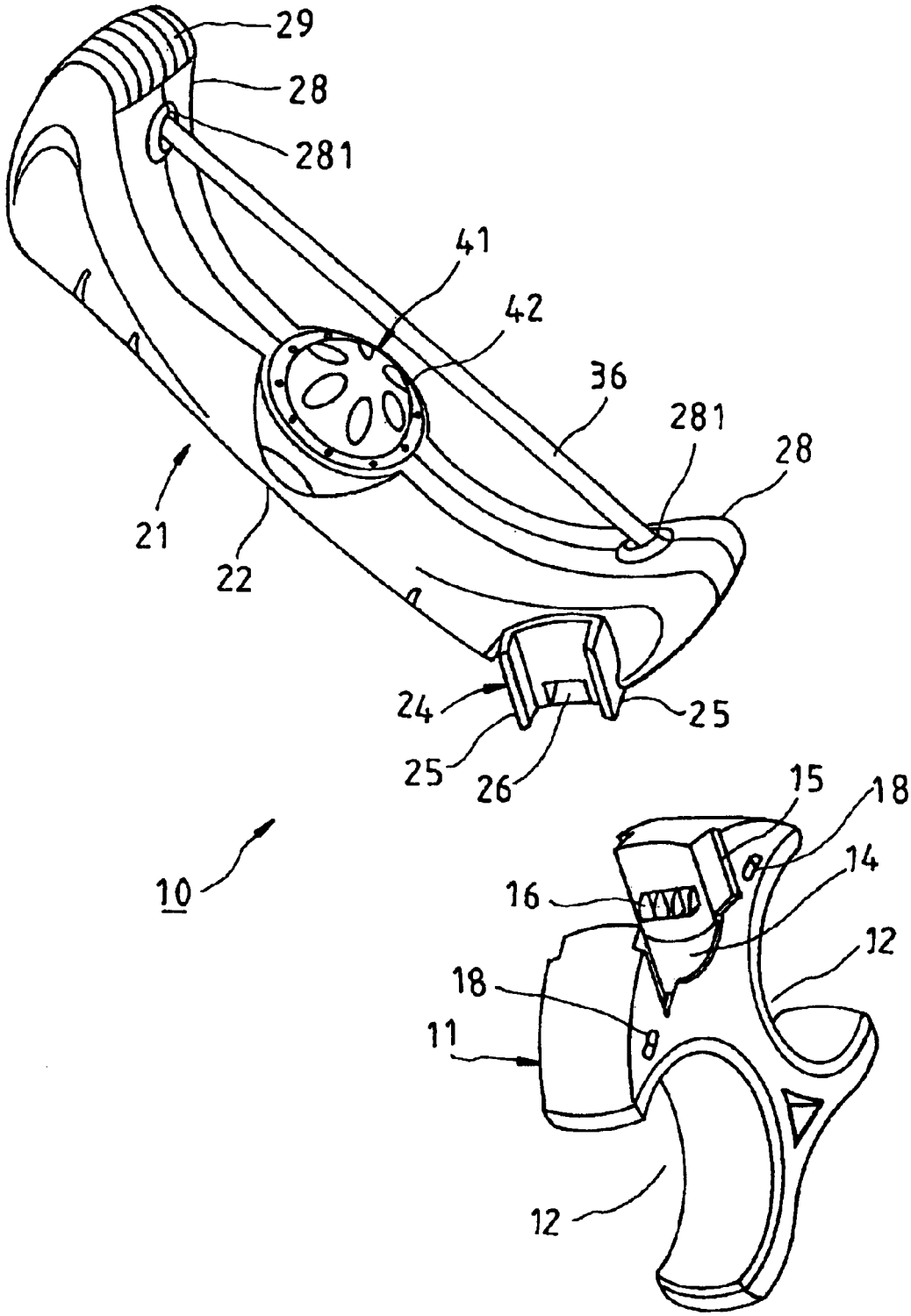
FIG. 2 is an exploded view of the preferred embodiment of the present invention.

Referring to FIGS. 1–5, a laptop rope pulling exerciser 10 constructed in accordance with a preferred embodiment of the present invention is composed of a base 11, an operating device 21, and a resistance device 41.

The base 11 includes two semicircular arched portions 12 recessed inwards respectively at two sides thereof for putting the user's two laps thereinto, a concave wedged portion 14 at a top end thereof having two lateral walls, two elastic plugs 16 mounted at the two lateral walls of the wedged portion 14, two push buttons 18 mounted on the base 11 and respectively connected with the two elastic plugs 16 for adjustably manipulating the two elastic plugs 16 by pushing the two push buttons 18, and two stepped portions 15 respectively positioned at two sides of the wedged portion 14.

The operating device 21 includes an elongated housing 22, a wedging portion 24, two chin portions 28, an interfering portion 32, a plurality of pulleys 34, and a continuous rope 36. The wedging portion 24 is positioned respectively at a bottom side of the housing 22 and has four sidewalls 25 and two slots 26 positioned between each two of the four sidewalls 25. The housing 22 is engaged with the wedged portion 14 at a bottom side thereof, each pair of the sidewalls 25 are engaged with one of the two stepped portions 15, and the two elastic plugs 16 are respectively engaged into the two slots 26. The two chin portions 28 extend outwards horizontally respectively from a top end and a bottom end of the housing 22, have a buffer cushion 29 mounted on a front side of the top end of the housing, and each have a through hole 281 corresponding to the other. The interfering portion 32 and the pulleys 34 are respectively disposed inside the housing 22. The rope 36 extends through the pulleys 34, the interfering portion 32, and the through holes 281 and runs inside and outside the housing 22. A locating member 33 is mounted on the interfering portion 32 and rotatably engaged with the rope for preventing the rope 36 from escape without generating too much friction.

The resistance device 41 includes an adjustment knob 42 rotatably mounted on the housing 22 in proximity of interfering portion 32, and a friction member 44 rotatably mounted to the adjustment knob 42 and having a friction wall 45 facing the interfering portion 32. The rope 36 extends through between the friction wall 45 and the interfering portion 32. The friction wall 45 has a recession 46 for receiving a portion of the rope 36 and further helping the rope 36 to be positioned in the recession 46. The friction member 44 is manipulated by the adjustment knob 42 to approach/leave the interfering portion 32 for tightening/loosening the rope 36, thereby adjustably manipulating the resistance device 41.

Figure 6:
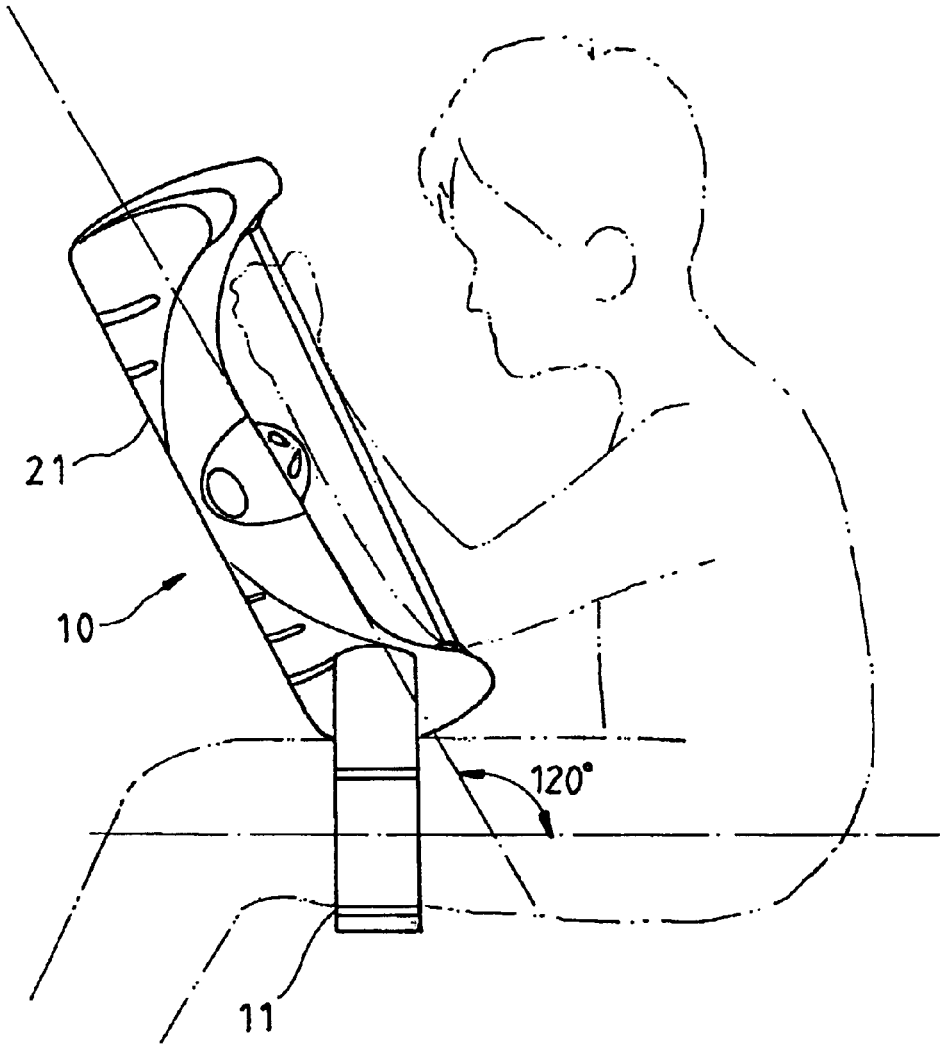
FIG. 6 is a schematic view of the preferred embodiment of the present invention at work.

Before operating the laptop rope pulling exerciser 10, as shown in FIG. 6, the base 11 is standing upright and the housing 22 longitudinally meets at an angle of 120° with the water level. In other words, while the laps are put into the arched portions 12, the housing 22 longitudinally meets at an angle of 120° with the laps.

Figure 3:
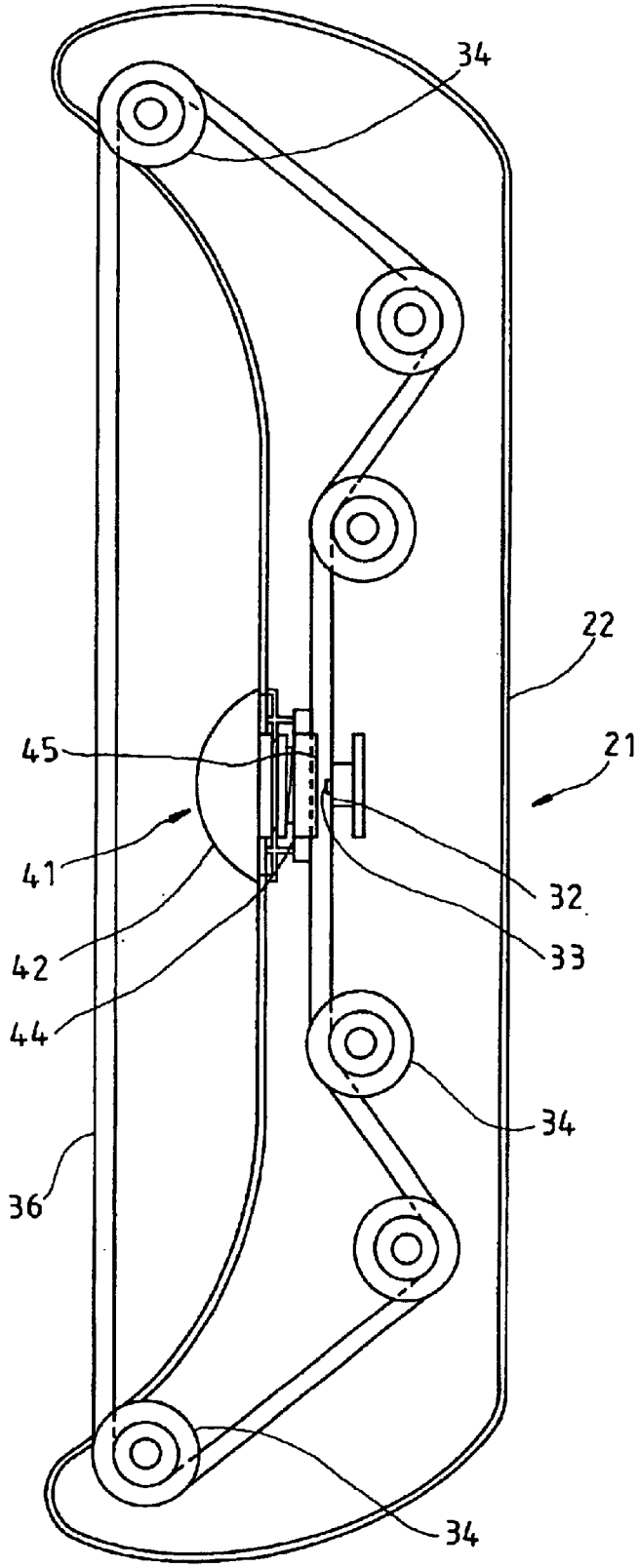
FIG. 3 is an internal view of the preferred embodiment of the present invention.
Figure 4:
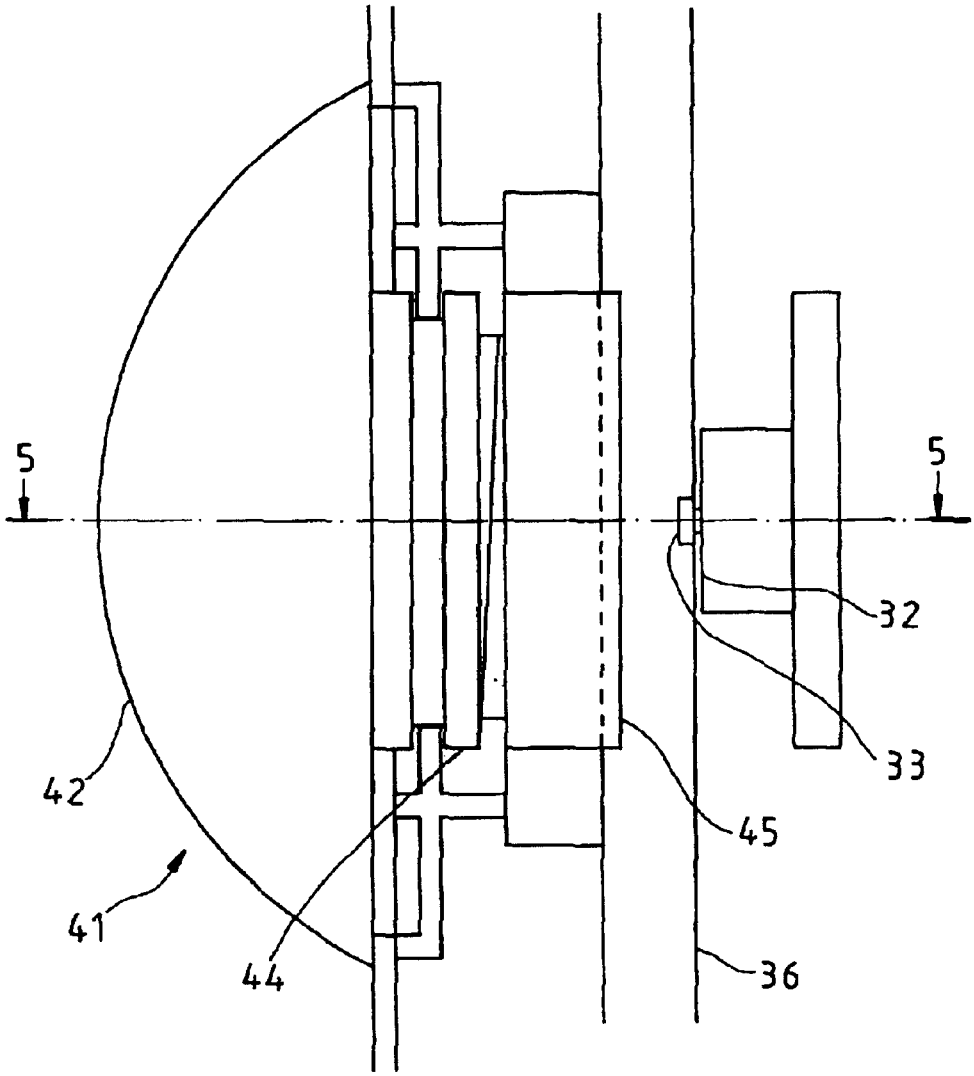
FIG. 4 is a partial enlarged view of FIG. 3.
Figure 5:
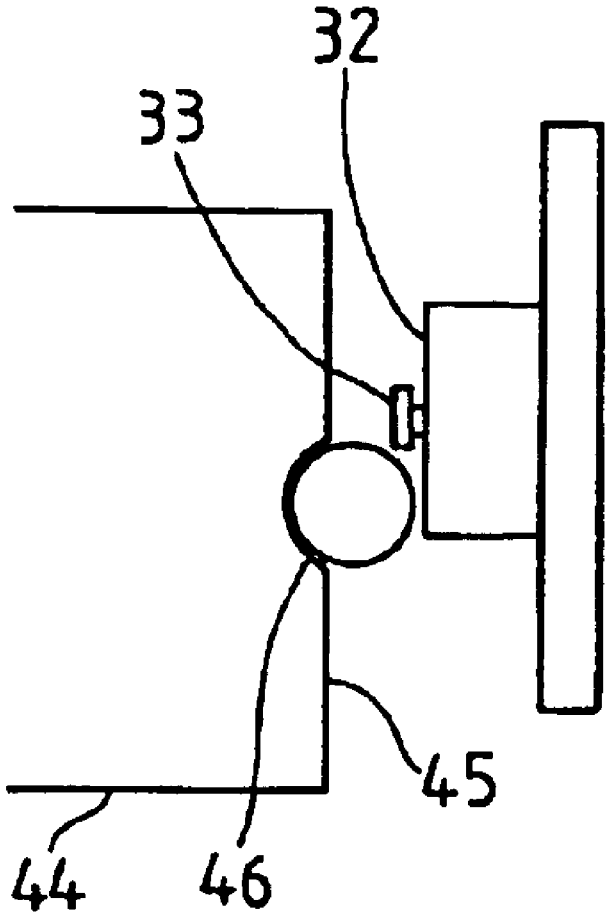
FIG. 5 is a sectional view taken along a line 5—5 indicated in FIG. 4.
Figure 7:
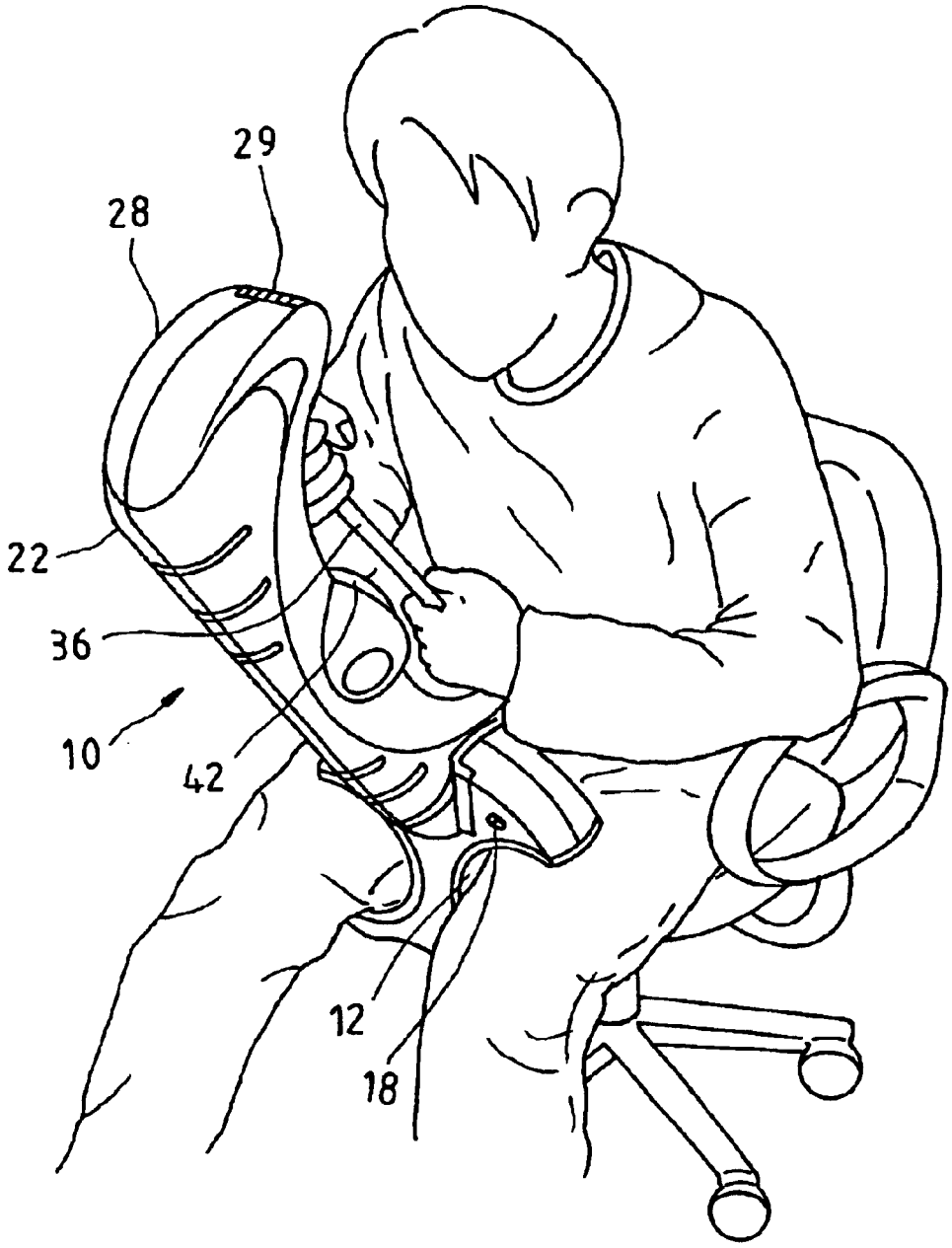
FIG. 7 is another schematic view of the preferred embodiment of the present invention at work.

Referring to FIGS. 1, 3, and 7, in operation, the user puts the laps into the two arched portions 12, and then pulls the rope 36 downwards by two hands to allow the resistance device 41 to generate reverse resistance against the user's pulling while the rope 36 circulatorily runs inside and outside the housing. Before the operation, the user can turn the adjustment knob 42 of the resistance device 41 to adjust the resistance generated by the friction between the friction member 44 and the rope 36 while pulling the rope 36.

In addition, while the user pulls the rope 36 downwards, the user will lean the head toward the chin portion 28 at the top end of the housing 22. The housing 22 longitudinally meets at an angle of 120° with the laps and the buffer cushion 29 is provided at the front end of the chin portion 28, thereby preventing the user's head from bumping the chin portion 28 and further preventing the user's head from injury while bumping the chin portion 28.

To set the housing 22 apart from the base 11, it is as easy as pushing the two push buttons 18 to disengage the two elastic plugs 16 from the two slots 26 and lifting the housing 22.

In conclusion, the present invention includes advantages as follows:

1. The present invention can be operated on the user's laps while the user sits so as to be more small-sized and compact to be stored than the prior art.
2. The present invention has smaller size so as to have lower production costs than the prior art.

What is claimed is:

1. A laptop rope pulling exerciser comprising:

a base including two arched portions recessed inwards respectively at two sides thereof for human laps put thereinto and a wedged portion positioned at a top end of said base;

an operating device including an elongated housing, a plurality of pulleys, and a continuous rope, said housing having a wedging portion detachably connected with said wedged portion, two chin portions extending outwards horizontally respectively from a top end thereof and a bottom end thereof, two through holes positioned respectively on said two chin portions and corresponding to each other, and an interfering portion mounted inside said housing, said pulleys being mounted inside said housing, said rope extending through said pulleys, said interfering portion, and through holes and running inside and outside said housing; and a resistance device including an adjustment knob rotatably mounted on said housing in proximity of said interfering portion and a friction member rotatably mounted to said adjustment knob, said friction member having a friction wall facing said interfering portion, said rope extending through between said friction wall and said interfering portion, said friction member being manipulated by said adjustment knob to approach/leave said interfering portion for tightening/loosening said rope, thereby adjusting the resistance of said resistance device.

2. The exerciser as defined in claim 1, wherein said arched portions are semicircular.

3. The exerciser as defined in claim 1, wherein said housing longitudinally meets at an angle of between 90° and 150° with a user's laps while the user puts the laps into and holds tight said two arched portions.

4. The exerciser as defined in claim 1, wherein said interfering portion comprises a locating member for keeping said rope running between said interfering portion and said friction wall from escape.

5. The exerciser as defined in claim 1, wherein said friction wall comprises a recession for receiving a portion of said rope and further helping said rope to be positioned.

6. The exerciser as defined in claim 1, wherein said wedged portion is a concavity; said base further comprises two elastic plugs at two lateral walls of said wedged portion, and two push buttons mounted thereon and respectively connected with said two elastic plugs, pushing said two push buttons to manipulate said two elastic plugs; said wedging portion comprises four sidewalls and two slots positioned between each two of said four sidewalls, whereby said four sidewalls are engaged with said base and said two elastic plugs are respectively engaged into said slots.

7. The exerciser as defined in claim 6, wherein said base comprises two stepped portions positioned respectively at two sides of said wedged portion; said sidewalls of said wedging portion being engaged with said stepped portions.

8. The exerciser as defined in claim 1, wherein said chin portion positioned at the top end of said housing comprises a buffer cushion at a front end thereof.

* * * * *